US007566291B2

(12) United States Patent
Lickle

(10) Patent No.: US 7,566,291 B2
(45) Date of Patent: Jul. 28, 2009

(54) BALANCE TRAINING DEVICE AND METHOD OF USE

(76) Inventor: Brett Lickle, 12-A Mamao Pl., Haiku, HI (US) 96708

( * ) Notice: Subject to any disclaimer, the term of this patent is extended or adjusted under 35 U.S.C. 154(b) by 510 days.

(21) Appl. No.: 10/760,324

(22) Filed: Jan. 20, 2004

(65) Prior Publication Data

US 2004/0224824 A1 Nov. 11, 2004

Related U.S. Application Data

(60) Provisional application No. 60/498,158, filed on Aug. 27, 2003, provisional application No. 60/468,246, filed on May 5, 2003.

(51) Int. Cl.
*A63B 22/00* (2006.01)

(52) U.S. Cl. ..... 482/51; 482/79; 482/146

(58) Field of Classification Search ..... 482/51, 482/79, 80, 146–148; D21/688, 689
See application file for complete search history.

(56) References Cited

U.S. PATENT DOCUMENTS 3,024,021 A * 3/1962 Coplin et al. ..... 482/146
3,352,559 A * 11/1967 Larsen ..... 473/269
3,488,049 A * 1/1970 Sasser, Jr. ..... 482/146
3,604,726 A * 9/1971 Tracy ..... 280/205
3,716,880 A * 2/1973 Sorenson ..... 441/67
3,806,116 A * 4/1974 Malmberg et al. ..... 482/147
3,862,768 A * 1/1975 England ..... 280/205
4,191,371 A * 3/1980 Armer, Jr. ..... 482/146
4,817,950 A 4/1989 Goo
5,048,823 A 9/1991 Bean
5,062,629 A 11/1991 Vaughan
5,415,589 A * 5/1995 Hall, Jr. ..... 472/25
5,509,871 A 4/1996 Giovanni
5,791,957 A * 8/1998 De La Cierva, Jr. ..... 441/65
5,851,166 A 12/1998 Bernardson
5,897,474 A * 4/1999 Romero ..... 482/146
6,168,551 B1 * 1/2001 McGuinness ..... 482/51
6,543,769 B1 4/2003 Podoloff et al.

OTHER PUBLICATIONS

Indoboard Advertisement; 1 Page.

* cited by examiner

*Primary Examiner*—Loan H Thanh
*Assistant Examiner*—Tam Nguyen
(74) *Attorney, Agent, or Firm*—McCarter & English

(57) ABSTRACT

The present invention includes a balance training board for simulating the sport of surfing and related activities. The board comprises an upper surface and a lower surface and the lower surface comprises a concave region adapted to communicate with a substantially spherical balancing insert. Also provided with the present invention is a surfboard accessory that is adapted for placement on a surfboard. The accessory comprises a concave surface adapted to receive a substantially spherical balancing insert. The accessory may be removable. Additionally, a method for exercising using a surf simulator board is provided.

12 Claims, 7 Drawing Sheets

BALANCE TRAINING DEVICE AND METHOD OF USE

CROSS REFERENCE TO RELATED APPLICATIONS

This application claims priority to U.S. Provisional application No. 60/498,158 filed Aug. 27, 2003 and U.S. Provisional application No. 60/468,246 filed May 5, 2003, both of which are incorporated by reference in their entirety.

FIELD OF THE INVENTION

The invention relates to an exercise and practice device for developing balance and coordination in general, and specifically for developing skills and techniques particular to sports such as surfing, wind surfing, snow boarding, skateboarding, wake boarding, and other related activities.

BACKGROUND OF THE INVENTION

Sports such as surfing, snow boarding, skateboarding, and other related activities require the use of advanced balancing skills on a relatively unstable board. Additional skills, such as the ability to quickly move from a prone position (on one's stomach) to a standing position while surfing, must also be mastered. It is, however, difficult to practice these balance skills in the actual environment of the activity (i.e. surfing in the water) because the opportunities to practice are limited. For example, the majority of a surfer's time is spent in the prone position paddling through the water in order to obtain a good position just seaward of breaking waves, or in the surf zone. In order to catch a wave and stand up, a surfer must paddle with that wave into the surf zone. Only after successfully "catching a wave" does a surfer get the opportunity to practice the balancing skills of standing on the board and riding the wave. Whether the attempt to ride the wave is successful or not, the wave is gone and the surfer must again reposition him or herself seaward of the surf zone. This perpetual repositioning not only takes time, but is also physically demanding, and surfers, particularly novice surfers, quickly become exhausted. Thus, the natural environment of surfing does not readily allow surfers the luxury of repeatedly practicing the movements of actually balancing on a surfboard on a consistent enough basis to learn the skill. This same dilemma applies equally to other surf and surf-related activities.

Simulators that provide the stability and feel of a surfboard moving through the water, as if surfing, have been developed that allow a surfer to practice his or her balancing skills out of the water. For example, some of these prior art surfing simulators use external forces from motors, pumps, levers, and the like, to actively generate motion and tilting angles in a surfboard-like standing platform. In reality, however, the movement of a surfboard is largely governed by changes in positionings and pressures applied by the surfer while surfing. Prior art surfing simulators which generate board motion independent of, and not subject to, the rider's foot positioning and foot pressure do not effectively simulate the actual sensation of surfing, or develop a user's ability to control and manipulate the surfboard.

Non-mechanical balancing devices, such as the Indoboard™, have also been developed to allow one to practice balancing skills. Devices such as the Indoboard™, however, are limited in their movement and do not accurately reflect the motions that are dealt with in an actual surfing ride. As such, there is a need for a practical balance training device that, when ridden, effectively mimics the actual motions experienced by a rider of a surf or surf-related board.

SUMMARY OF THE INVENTION

The present invention includes a balance training board. The balance training board comprises an upper surface and a lower surface, wherein the lower surface comprises a concave region adapted to ride on a substantially spherical balancing insert.

In another aspect of the present invention, a balance training device is provided that comprises a board and a single substantially spherical balancing insert. In this embodiment, the board comprises an upper surface and a lower surface, wherein the lower surface comprises a concave region extending into the board below the upper surface. The concave region is adapted to receive the balancing insert, whereby the board rides over the balancing insert. The concave region may encompass between about 15% and about 95% of the lower surface area. Also, the concave region may comprise an oval shape, a circular shape, or a rectangular shape.

In an additional aspect, a platform adapted to support the exercise device is provided. In one embodiment, the platform comprises a convex top surface and a substantially flat bottom surface. The convex top surface is adapted to communicate with the balancing insert. In an alternate embodiment, the platform is adapted to support the exercise device, and the platform comprises a concave top surface and a substantially flat bottom surface. In this embodiment, the concave top surface is adapted to communicate with the balancing insert.

Also provided with the present invention is a surfboard accessory that is adapted for placement on a surfboard. The surfboard comprises an upper surface and a lower surface, and the accessory comprises a substantially flat surface adapted to affix to the lower surface of the surfboard. The accessory also comprises a concave surface opposite the flat surface, and the concave surface is adapted to receive a substantially spherical balancing insert. The accessory may be removable.

In yet another embodiment, a method for exercising is provided. The method comprises: providing a board comprising an upper surface and a lower surface, wherein the lower surface comprises a concave region extending into the board below the upper surface; positioning the board whereby the concave region receives a substantially spherical balancing insert; and maneuvering the board over the balancing insert. The method may further comprise placing the balancing insert on a platform, or selecting the surface area of the concave region to accommodate a user's skill level. Additionally, the method may comprise sequentially increasing the method difficulty by increasing the surface area of the concave region.

DETAILED DESCRIPTION OF THE INVENTION

The present invention provides a balance training device for simulating surf sport motion, practicing surfing and related activities, exercising and strengthening muscles, and developing balance skills. The balance training device comprises a balance training board having an upper surface and a lower surface and can have variable shapes and dimensions in accordance with typical surfboards, or other related boards as known in the art. Unlike typical surfboards however, the lower surface of the board of the present invention has a concave region therein adapted to communicate with a substantially spherical balancing insert. The concave region is adapted to receive a balancing insert, such as a ball or inflatable bladder, such that the board is able to rest on and travel over the rolling insert, within a defined, concave area.

When positioned on a balancing insert, such as a ball, the concave region of the board restricts the board's motion over the ball by containing the ball within the concave region. By restricting the ball within the concave region, the board moves in a limited manner, allowing a user to maintain balance without the frustration of having the board roll off the ball.

Figure 1A:
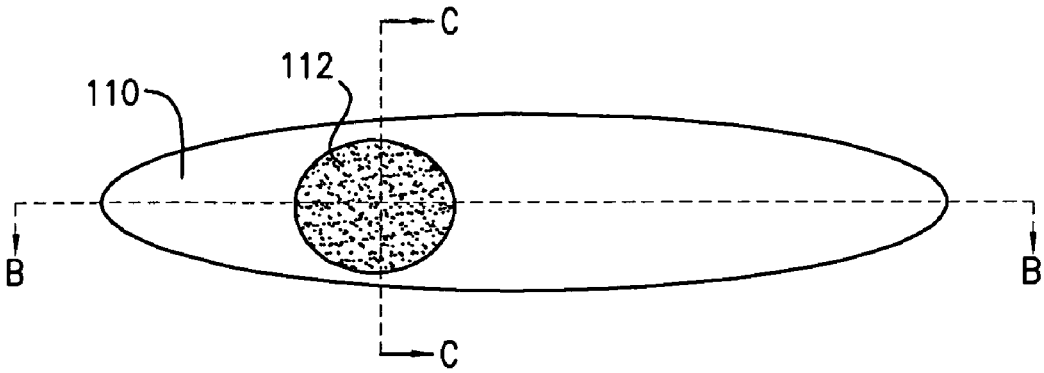
FIG. 1A is a schematic of the bottom view of a surf simulator of the present invention optimized for an inexperienced user.
Figure 1B:
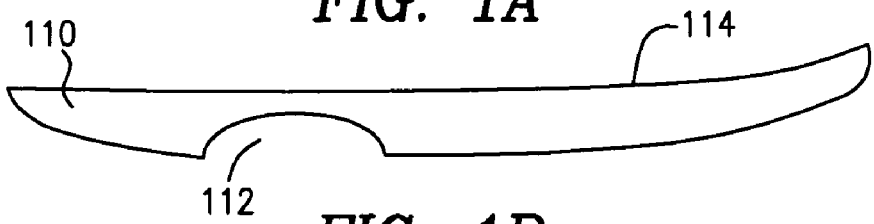
FIG. 1B is a schematic of the cross-sectional view along the line B of FIG. 1A.
Figure 1C:
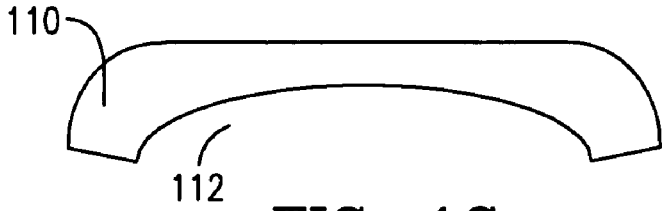
FIG. 1C is a schematic of the cross-sectional view along the line C of FIG. 1A.

The concave region of the board can be of varying sizes. The selection of a particular size of the concave region will depend upon the level of skill of the user. For instance, a larger concave area allows greater travel of the board over the balancing insert, resulting in increased difficulty in maneuvering the board, whereas a smaller region will be less difficult to manage. FIGS. 1-4 illustrate some possible variations in the size and shape of the concave region. As shown in FIG. 1A, the bottom surface of the board 110 has a concave region shown as shading 112, which is approximately circular. The dashed line B in the figures indicates the cross sectional view shown in FIG. 1B. This cross-sectional view shows the concave region of the board as a cut-out of a typical surfboard. The concave region extends from the lower surface of the board 110 into the board, with the apex of the concave region below the top surface of the board 114. Regardless of the surface area of the concave region, the upper surface of the board above the concave region remains substantially flat, like a conventional surf board, allowing a user to stand on the board without awareness of the outline of the concave region below.

While there is no requirement as to the material the board is made from, it is preferable that the board be made from resilient material that can withstand the rigors of use as described herein. Some exemplary materials include fiberglass, plastic, wood, hard rubber and foam among others. It is further contemplated that the board can be made from a clear material, such as Plexiglas. The clear material allows the user to see the insert while riding the board, thus making the ride somewhat easier, especially for beginners.

Figure 2A:
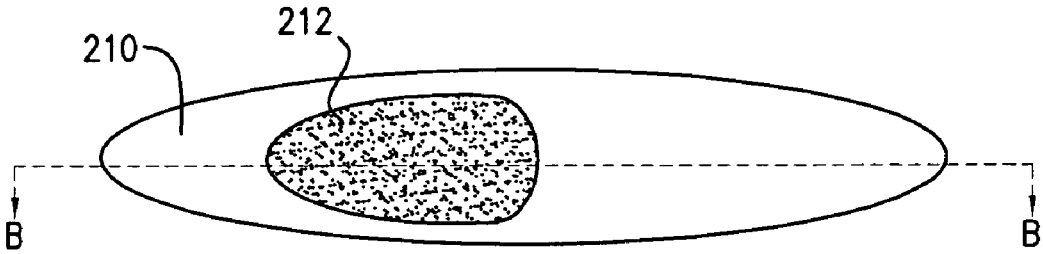
FIG. 2A is a schematic of the bottom view of a surf simulator of the present invention providing greater difficulty in operating than the simulator in FIG. 1.
Figure 2B:
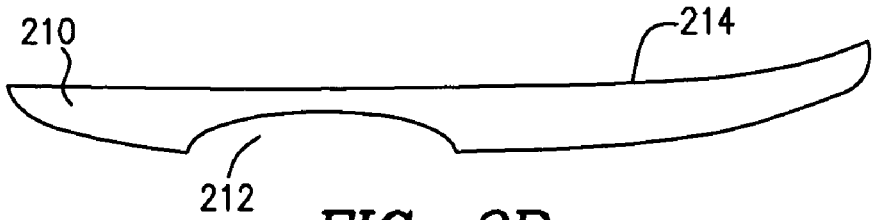
FIG. 2B is a schematic of the cross-sectional view along the line B of FIG. 2A.
Figure 3A:
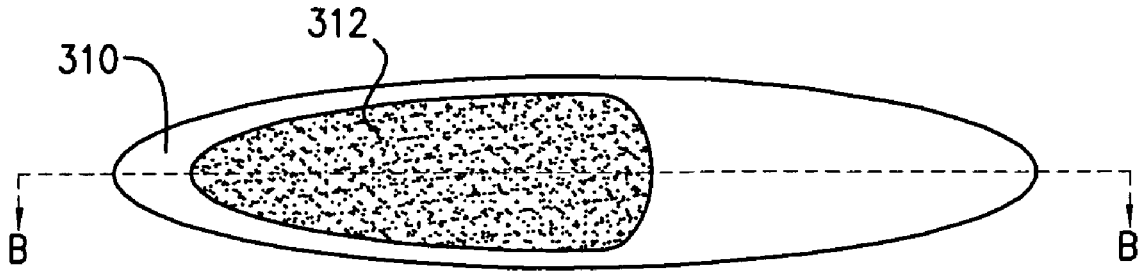
FIG. 3A is a schematic of the bottom view of a surf simulator of the present invention is providing greater difficulty in operating than the simulators in FIGS. 1 and 2.
Figure 3B:
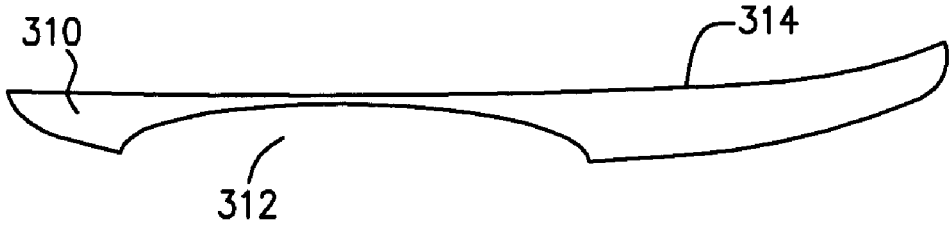
FIG. 3B is a schematic of the cross-sectional view along the line B of FIG. 3A.
Figure 4A:
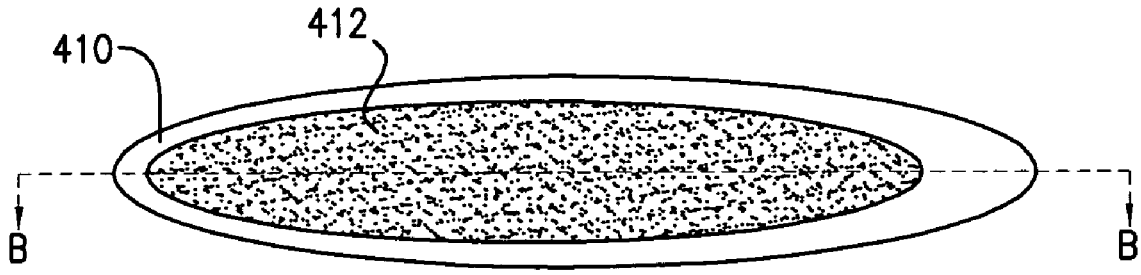
FIG. 4A is a schematic of the bottom view of a surf simulator of the present invention providing greater difficulty in operating than the simulators in FIGS. 1, 2, and 3.
Figure 4B:
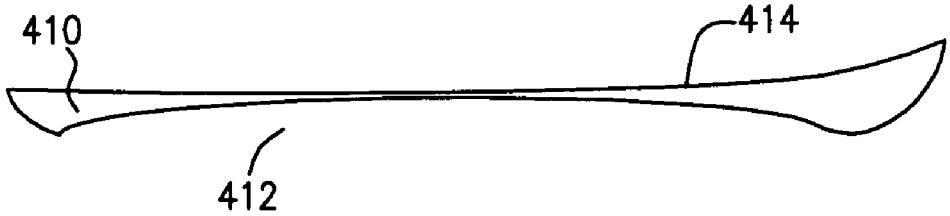
FIG. 4B is a schematic of the cross-sectional view along the line B of FIG. 4A.

FIGS. 2A-4B illustrate the bottom surfaces and cross-sectional views of boards with varying sizes and shapes of the concave region. FIG. 2A shows the bottom of a board 210 with a concave region 212 allowing greater range of motion in the center of the board. FIG. 2B shows the cross-sectional view of the board with concave region 212 extending from the bottom surface of the board 210, up into the board with the apex below the upper surface of the board 214. FIG. 3A shows the bottom of a board 310 with a concave area 312 which is still greater in size, extending to the rear of the board. FIG. 3B shows the cross-sectional view of the board with concave region 312 extending from the bottom surface of the board 310, up into the board with the apex below the upper surface of the board 314. FIG. 4A shows the bottom of a board 410 with a concave area 412 which is still greater in size, extending to the rear, and the front of the board. FIG. 4B shows the cross-sectional view of the board with concave region 412 extending from the bottom surface of the board 410, up into the board with the apex of the concave region below the upper surface of the board 414.

Figure 5:
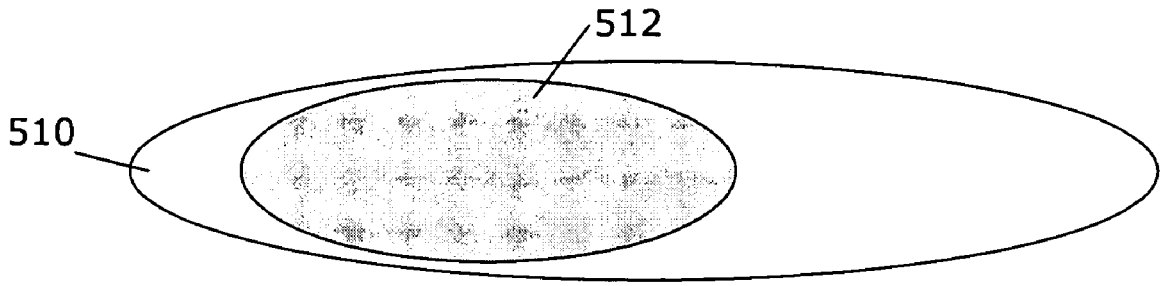
FIG. 5 is a schematic of another embodiment of the surf simulator of the present invention.
Figure 6:
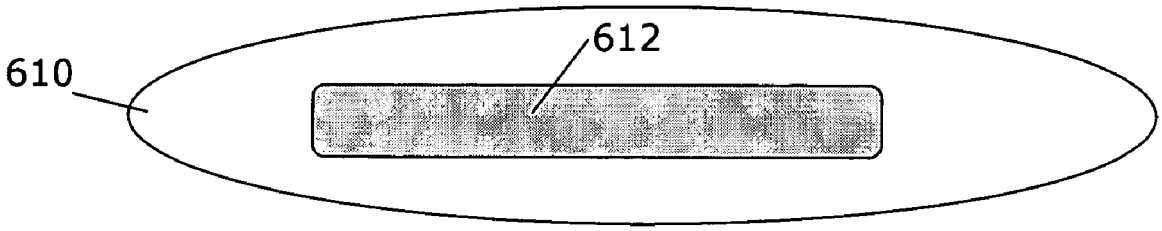
FIG. 6 is a schematic of another embodiment of the surf simulator of the present invention.

Further alternative shapes for the concave region are depicted in FIGS. 5 and 6. FIG. 5 depicts an oblong shaped concave region 512 on the bottom surface 510 wherein the region 512 narrows at both the front and rear of the board. On the other hand, FIG. 6 depicts a rectangular shaped concave region 612 on the bottom surface 610 that does not narrow at the ends of the board. Various other shapes of the concave region are contemplated and include diamond, cross and star-shaped patterns.

As suggested by the figures, the concave region can encompass between about 15% and about 95% of the lower surface area of the board. Generally, regardless of the shape or size of the concave region, the depth of the concave region is not critical so long as it is deep enough to contain the spherical insert therein.

In a preferred embodiment of the present invention, the board is combined with an insert to form an exercise device. The device comprises a board, as described above, and a single substantially spherical balancing insert. The lower surface of the board will comprise a concave region extending into the board below the upper surface and adapted to receive the balancing insert. The board should sit on the insert in such a way that it can travel or ride over the balancing insert when a user is balancing thereon.

The size and shape of the spherical balancing insert can be varied. With regard to its shape, the balancing insert is preferably substantially spherical or ball-shaped, providing primarily even rotational motion. Slight derivation from spherical geometry is tolerable, especially when the balancing insert is deformable with pressure, such as a bladder, balloon, or a bag inflated with air or water.

With regard to its size, because the ball is limited in motion to the concave region, a relatively large ball (one with only slightly smaller diameter than the concave region), limits the motion of the board such that a novice user can maintain balance on the board.

The level of difficulty in maintaining balance on the board can be increased by providing a larger insert. A larger insert lifts the board further from the ground, thus increasing instability of the board with the increased play. A smaller insert, on the other hand, reduces the difficulty of maintaining balance.

Inserts may vary in size depending on the skill and size of the user, or merely by preference. A portable device may benefit from a smaller insert size. A larger size may be preferred for use in a permanent or fixed exercise device. Accordingly, balancing inserts may vary considerably in size. The balancing insert may be made of a variety of materials. Preferably, the balancing insert material is resilient. Examples would include balls having the characteristics of a medicine ball, a basketball, a tennis ball, or any other spherical insert having some resiliency. The use of a completely solid insert is also contemplated, but would likely require some form of reinforcement in the concave, and even throughout the entire board itself, to alleviate the potential damage that a solid ball would cause during the ride.

While there is no requirement that the concave region and the balancing insert of the device have any specific surface quality, it may be desirable that they have compatible surfaces. For example, the concave region and the balancing insert may be coated with a hook and loop connection material, such as VELCRO®. Alternatively, the concave region may have a texturizing coating that is compatible with the surface of the balancing insert. The compatible textures of the concave region and the insert would then form a slight adherence with each other. It is preferred that such an adherence must still permit the insert to roll within the concave region, but ideally it should slow down the movement of the ride and prevent the insert from slipping outside of the concave region. Other non-limiting examples of appropriate surface coatings include rubber, plastic, and sand paper.

Figure 7A:
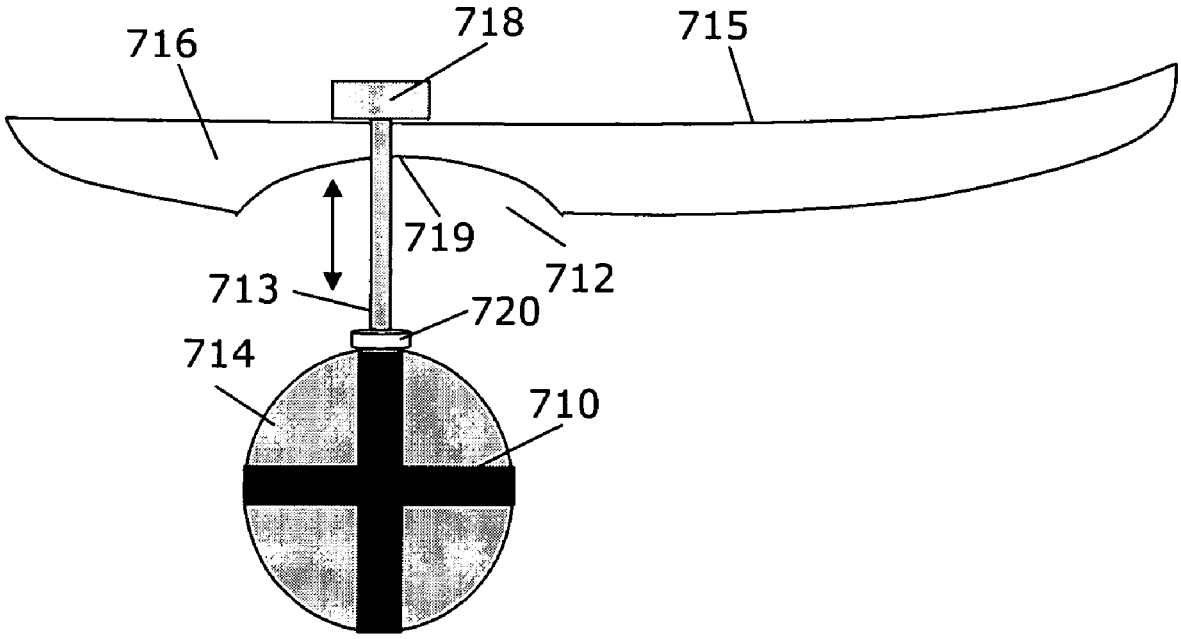
FIG. 7A is a schematic of a cross-sectional view of a surf simulator of the present invention with a stabilizing bar component.
Figure 7B:
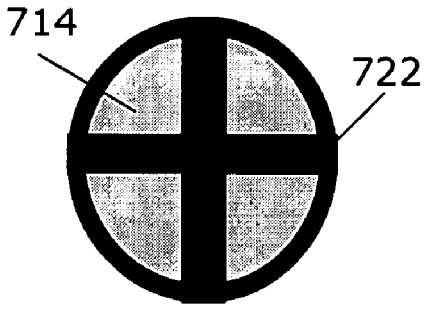
FIG. 7B is a schematic of an alternative balancing insert.

Instead of incorporating compatible surfaces to prevent the insert from slipping out of the concave region, the insert and board may be modified so that the board further comprises a securing device adapted to secure the balancing insert to the board. One embodiment providing such a securing mechanism is illustrated in FIG. 7A. A cross-section of the board 716 is shown to illustrate the securing mechanism. A securing element 713, such as a tethering rope, extends through a hole in the board to a fastener 718 secured to the upper surface 715 of the board. The fastener 718 may allow for adjusting the length of the securing element, such as a string winder with a boa ratchet system. The securing element 713 is shown extending through the apex 719 of the concave region 712, and attaching to a balancing insert connector 720. The connector 720 connects to the securing element 713 to a harness 710 encompassing the balancing insert 714. The harness 710 is shown in FIGS. 7A and 7B in grey and may be a harness comprising a few adjustable straps, a web of straps, or a net encasing the balancing insert. In one embodiment, a deflated balancing insert is inserted into the harness and the balancing insert is then inflated sufficiently for the harness to be secured around the inflated balancing insert.

The securing element 713 is preferably adjustable in length, and the fastener 718 preferably allows the user to adjust the length of the securing element by winding or unwinding the tethering rope or string 713. The level of difficulty in maneuvering the device can be adjusted by increasing the length of the securing element.

The connector 720 may be sewn or otherwise attached directly to the harness, or it may comprise a clip or snap attachment between the balancing insert harness and the securing element. As shown in FIG. 7A the balancing insert is a ball 714 encompassed in a harness 710 secured to a tethering rope 713 through a connector 720. The harness as shown in FIG. 7A comprises three straps that extend the entire longitude of the balancing insert. In FIG. 7B, a balancing insert 714 is shown in a harness 710 comprising multiple longitudinal straps 721 and latitudinal straps 722. The harness may also be in the form or a web or netting material encompassing the balancing insert.

Figure 8:
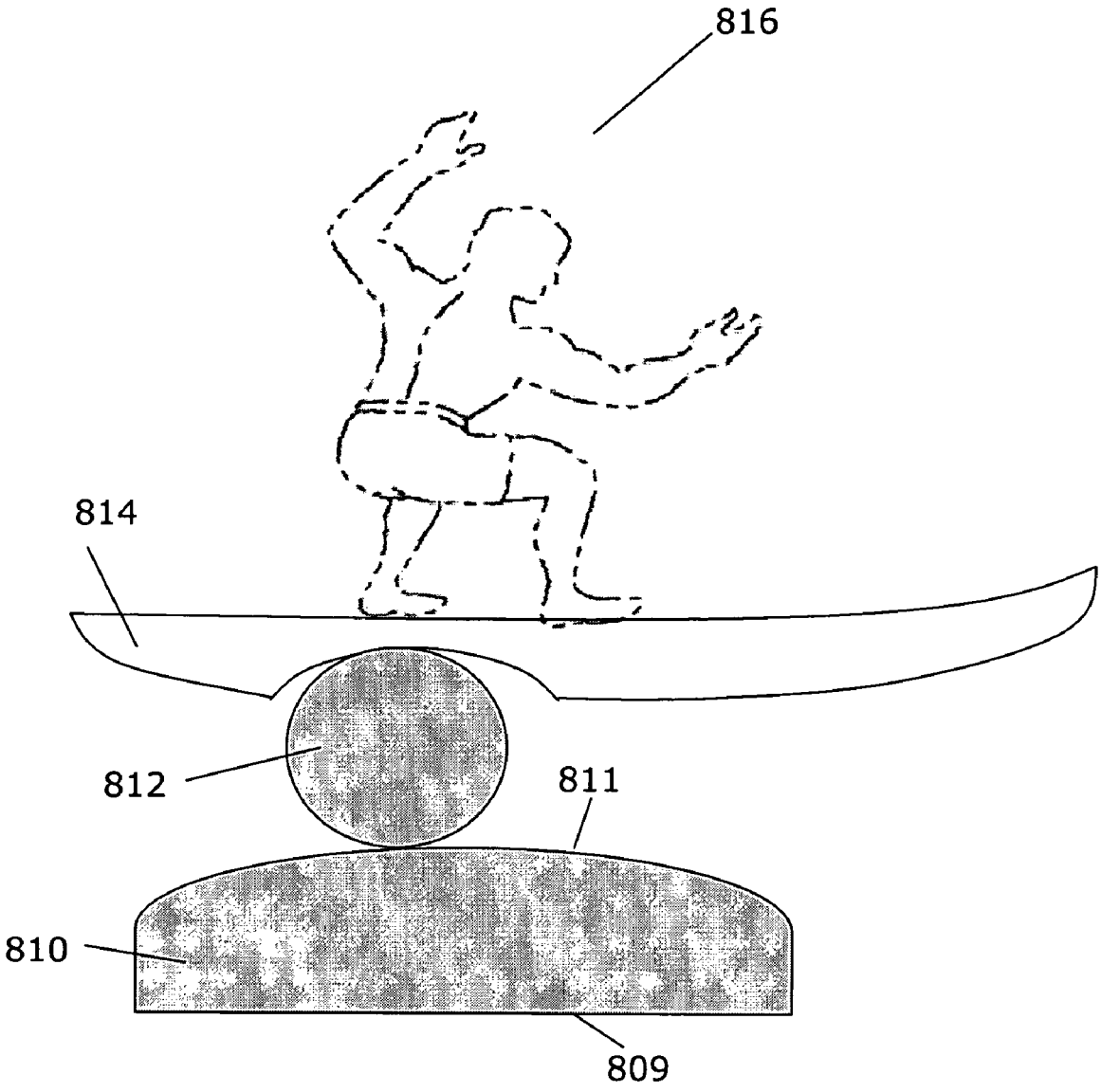
FIG. 8 is a schematic of a surf simulator of the present invention with a convex platform component.
Figure 9:
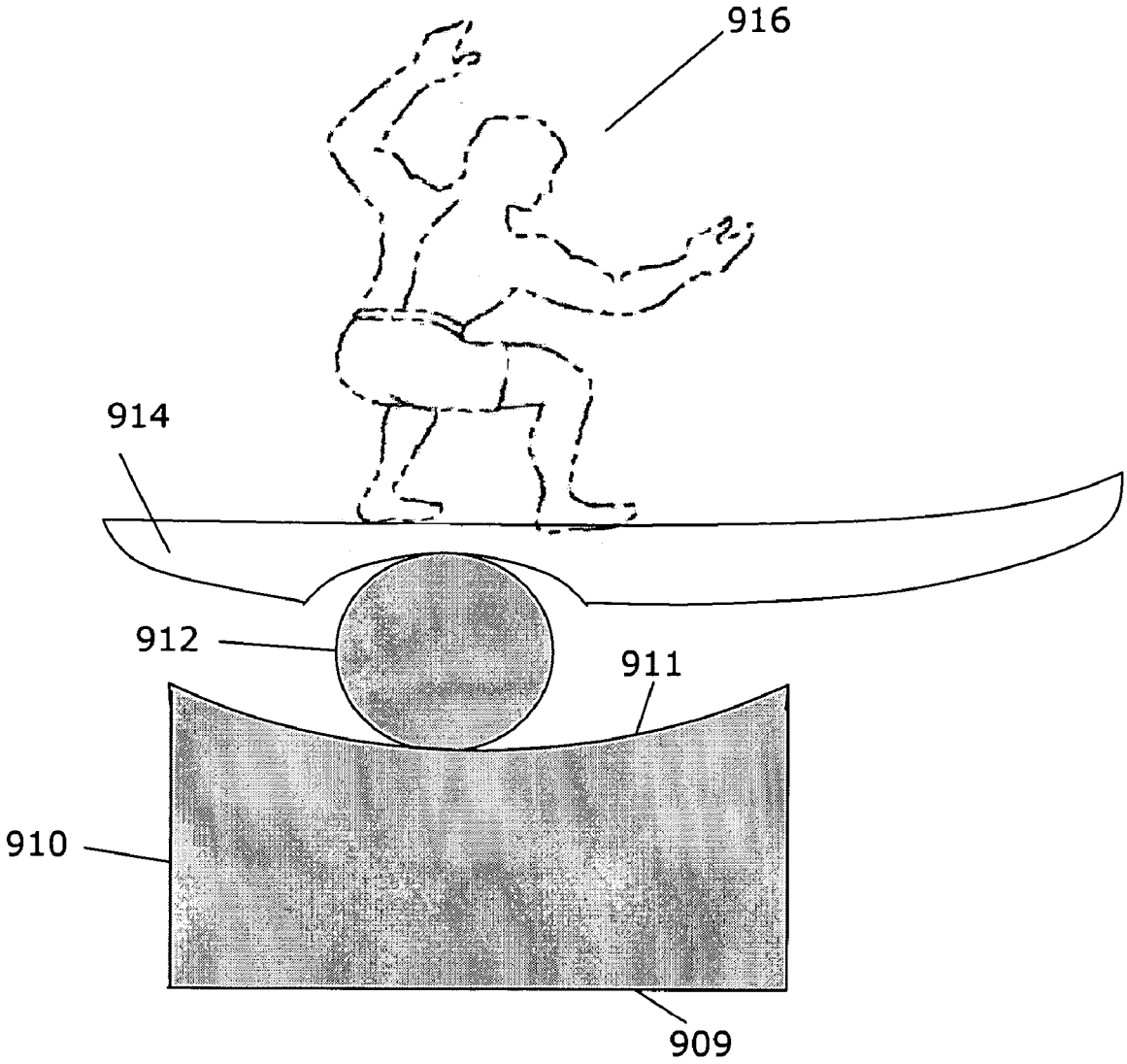
FIG. 9 is a schematic of a surf simulator of the present invention with a concave platform component.

In yet another embodiment of the present invention, a platform is provided to support the exercise device. While the shape of the platform can vary significantly, it is contemplated that the more common shape will either be a concave or a convex surface on which the exercise device will ride. The various contemplated surface structures of the platform add another component of motion for the balancing insert, thus adding an additional degree of difficulty for the user in balancing and maneuvering the board on the balancing insert. in FIG. 8 depicts a platform 810 having a convex top surface 811 and a substantially flat bottom surface 809. The convex top surface 811 of the platform 810 is adapted to communicate with the balancing insert 812, such that the board 814 can be ridden on top of the balancing insert 812 by the user 816. Alternatively, as shown in FIG. 9, the platform 910 has a concave top surface 911 and a substantially flat bottom surface 909 wherein the concave top surface 911 is adapted to communicate with the balancing insert 912.

The platform can be made of any durable material strong enough to support the exercise device and its rider. Some exemplary materials would include plastic, fiberglass, rubber or wood among others. The top surface can also be coated with a compatible texturing surface to provide adherence to the balancing insert such as, for example, velcro® as described above.

Figure 10:
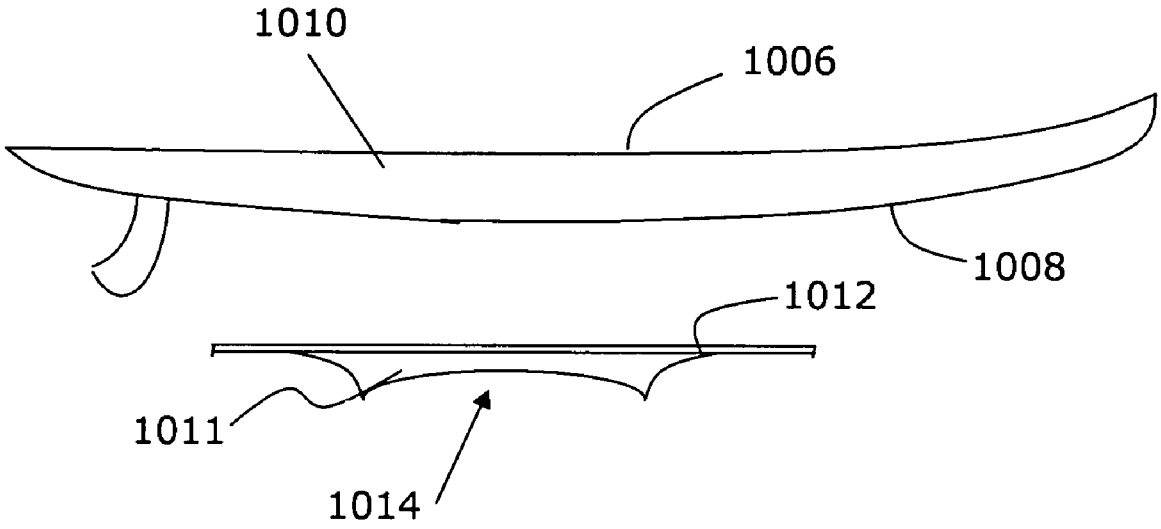
FIG. 10 is a schematic of an accessory for adapting a surfboard to a surf simulator device of the present invention.

The invention also provides a surfboard accessory that provides a means for temporarily converting a standard, functional surfboard into an exercise device. The accessory 1011, illustrated in FIG. 10, is preferably adapted for removable placement on the lower surface 1008 of a surfboard 1010. Preferably, the accessory 1011 has a substantially flat surface 1012 adapted to affix to the lower surface 1008 of the surfboard. Because the lower surface 1008 of a surfboard may not be completely flat, the accessory 1011 is preferably adapted to conform to the shape of the surfboard. The accessory also preferably has a concave surface 1014 opposite the flat surface 1012 adapted to receive a the substantially spherical balancing insert of this invention.

It is contemplated that the concave surface 1014 of the accessory 1011 would have any of the characteristics described above for the concave region of the board, depending upon the user's desires, including various shapes and sizes selected according to the users skill and experience level.

The accessory can be made of any resilient material such as rubber, nylon, fiberglass, or plastic, among others, and preferably, the accessory is removable. The accessory would allow the user to use a standard surfboard to practice surfing using the balancing insert. When the accessory is attached to the lower surface of the surfboard, the user can balance the board on a balancing insert and ride the board on the balancing insert as described above for the board of this invention.

A method for exercising is also provided. The method includes: providing a board comprising an upper surface and a lower surface, wherein the lower surface comprises a concave region extending into the board below the upper surface; positioning the board whereby the concave region receives a substantially spherical balancing insert; and maneuvering the board over the balancing insert.

In performing this method, a user will use a board as described above, or a standard surfboard equipped with an accessory as described above, and position the board over a balancing insert, such as one previously described herein. The method includes placing the concave region of the board, or the accessory, onto the balancing insert. With the board positioned on the balancing insert, the user mounts the board, either on their stomach, hands and knees, standing on their knees, or on their feet, and balances the board on the balancing insert. The user then maneuvers their weight to control the motion of the board.

The method may also include placing the balancing insert on a platform as described above. The method may provide for various user skill levels in selecting the surface area of the concave region to accommodate a user's skill level, by sequentially increasing the method difficulty by increasing the surface area of the concave region, or increasing the size of the balancing insert.

Although the invention is illustrated and described herein with reference to specific embodiments, the invention is not intended to be limited to the details shown. Rather, various modifications may be made in the details within the scope and range of equivalents of the claims and without departing from the invention.

What is claimed:

1. A balance training device for a user to maneuver by balancing the user's weight on the device, the device comprising a board and consisting of only one substantially spherical balancing insert, the balancing insert having a circumference, the board comprising a central longitudinal axis, a central lateral axis, an upper surface defining an upper surface area and a lower surface defining a lower surface area, wherein the lower surface comprises a concave region extending into the board from the lower surface toward the upper surface whereby the apex of the concave region is disposed between the lower surface and the upper surface, and the concave region is positioned off center with respect to the lateral axis and centrally positioned with respect to the longitudinal axis, the concave region adapted to receive the balancing insert, whereby the board rides over the balancing insert, and wherein the concave region encompasses an area within the lower surface greater than an area defined by the circumference of the balancing insert the entire upper surface area is substantially flat and smooth and adapted to support the user during use, and the area encompassed by the concave region is less than the entire upper surface area.

2. The balance training device of claim 1 wherein the concave region encompasses between about 15% and about 95% of the lower surface area.

3. The balance training device of claim 1 wherein the concave region comprises a substantially oval shape.

4. The balance training device of claim 1 wherein the concave region comprises a substantially circular shape.

5. The balance training device of claim 1 wherein the concave region comprises a substantially rectangular shape.

6. The balance training device of claim 1 wherein the board further comprises a securing device adapted to secure the balancing insert to the board, wherein the securing device extends through the board from the lower surface to the upper surface.

7. The balance training device of claim 1, further comprising a platform having a convex top surface and a substantially flat bottom surface, said balancing insert riding on said top surface.

8. The balance training device of claim 1, further comprising a platform having a concave top surface and a substantially flat bottom surface, said balancing insert riding on said top surface.

9. A method for exercising comprising:

A. providing a board comprising an upper surface and a lower surface, wherein the lower surface comprises a central longitudinal axis, a central lateral axis, a concave region extending into the board from the lower surface toward the upper surface whereby the apex of the concave region is disposed between the lower surface and the upper surface, and the concave region is positioned off center with respect to the lateral axis and centrally positioned with respect to the longitudinal axis;

B. placing a single substantially spherical insert on a flat surface, wherein the balancing insert has a circumference;

C. positioning the board on said substantially spherical insert whereby the concave region receives said substantially spherical balancing insert and the board rides on said spherical balancing insert and the concave region encompasses an area within the lower surface greater than an area defined by the circumference of the balancing insert; and D. mounting on said board and maneuvering the board over the balancing insert.

10. The method of claim 9 wherein the step of placing the spherical insert on a flat surface further includes placing a platform having a top surface on said flat surface and placing the spherical insert on said top surface of said platform.

11. The method of claim 9 wherein the step of providing a board includes providing a plurality of boards each having a different concave region each of said concave region and the spherical inserts corresponding to a different degree of balancing difficulty and there is further included a step of selecting one of said boards and spherical insert combinations to obtain a desired level of exercise difficulty.

12. The method of claim 11 further comprising sequentially increasing the method difficulty by selecting boards with gradually increased surface area in the concave region.

* * * * *